US009227294B2

(12) United States Patent
Cheng et al.

(10) Patent No.: US 9,227,294 B2
(45) Date of Patent: Jan. 5, 2016

(54) APPARATUS AND METHOD FOR CHEMICAL MECHANICAL POLISHING

(71) Applicant: TAIWAN SEMICONDUCTOR MANUFACTURING COMPANY LTD., Hsinchu (TW)

(72) Inventors: Chung-Liang Cheng, Changhua County (TW); Yen-Yu Chen, Taichung (TW); Chang-Sheng Lee, Shin-Chu (TW); Wei Zhang, Chupei (TW)

(73) Assignee: TAIWAN SEMICONDUCTOR MANUFACTURING COMPANY LTD., Hsinchu (TW)

( * ) Notice: Subject to any disclaimer, the term of this patent is extended or adjusted under 35 U.S.C. 154(b) by 44 days.

(21) Appl. No.: 14/145,192

(22) Filed: Dec. 31, 2013

(65) Prior Publication Data

US 2015/0183080 A1 Jul. 2, 2015

(51) Int. Cl.

| | |
|---|---|
| ***B24B 37/00*** | (2012.01) |
| ***B24B 37/013*** | (2012.01) |
| ***B24B 49/10*** | (2006.01) |
| ***B24B 37/20*** | (2012.01) |

(52) U.S. Cl.

CPC ..... *B24B 37/013* (2013.01); *B24B 37/205* (2013.01); *B24B 49/10* (2013.01)

(58) Field of Classification Search

CPC .... B24B 49/16; B24B 37/013; B24B 37/042; B24B 49/12; B24B 49/00; B24B 37/205; B24B 49/04; B24B 37/04

USPC ..... 451/5, 6, 41, 27, 285–290, 398, 104, 451/113, 10–11, 54, 36; 204/192, 25; 205/667

See application file for complete search history.

(56) References Cited

U.S. PATENT DOCUMENTS

| | | | | |
|---|---|---|---|---|
| 5,308,438 | A * | 5/1994 | Cote | B24B 37/013 216/86 |
| 5,575,706 | A * | 11/1996 | Tsai et al. | 438/693 |
| 5,639,388 | A * | 6/1997 | Kimura | B24B 37/013 216/84 |
| 5,688,364 | A * | 11/1997 | Sato | 438/693 |
| 5,807,165 | A * | 9/1998 | Uzoh et al. | 451/41 |
| 5,911,619 | A * | 6/1999 | Uzoh et al. | 451/5 |
| 6,066,030 | A * | 5/2000 | Uzoh | 451/41 |
| 6,342,166 | B1 * | 1/2002 | Ide et al. | 216/84 |
| 6,368,190 | B1 * | 4/2002 | Easter et al. | 451/41 |
| 6,379,223 | B1 * | 4/2002 | Sun et al. | 451/41 |
| 6,435,942 | B1 * | 8/2002 | Jin et al. | 451/8 |
| 6,537,133 | B1 * | 3/2003 | Birang et al. | 451/6 |
| 6,722,942 | B1 * | 4/2004 | Lansford | B23H 5/08 204/192.25 |
| 6,846,227 | B2 * | 1/2005 | Sato et al. | 451/288 |
| 6,848,970 | B2 * | 2/2005 | Manens et al. | 451/5 |
| 6,916,225 | B2 * | 7/2005 | Sugiyama et al. | 451/6 |
| 7,125,324 | B2 * | 10/2006 | Palmgren et al. | 451/177 |
| 7,189,139 | B2 * | 3/2007 | Ono | B24B 53/017 451/11 |
| 7,276,743 | B2 * | 10/2007 | Manens et al. | 257/127 |
| 7,422,982 | B2 * | 9/2008 | Wang et al. | 438/692 |

(Continued)

*Primary Examiner* — George Nguyen

(74) *Attorney, Agent, or Firm* — Chun-Ming Shih

(57) ABSTRACT

An apparatus for chemical mechanical polishing includes a wafer carrier, a first electrode, a rotatable pedestal, a second electrode, and an electric current detector. The first electrode is disposed at the wafer carrier. The rotatable pedestal is positioned opposite to the wafer carrier in order to perform a polishing operation with the wafer carrier accordingly. The second electrode is disposed at the rotatable pedestal and electrically coupled to the first electrode in order to form a circuit loop. The electric current detector is between the first electrode and the second electrode.

20 Claims, 12 Drawing Sheets

(56) References Cited

U.S. PATENT DOCUMENTS

| | | | | |
|---|---|---|---|---|
| 7,947,163 | B2 * | 5/2011 | Mayer et al. | 205/667 |
| 2002/0061714 | A1 * | 5/2002 | Doan et al. | 451/41 |
| 2002/0070126 | A1 * | 6/2002 | Sato et al. | 205/640 |
| 2003/0045207 | A1 * | 3/2003 | Taylor | 451/6 |
| 2008/0057837 | A1 * | 3/2008 | Shiratani et al. | 451/57 |
| 2008/0090500 | A1 * | 4/2008 | Hellring et al. | 451/57 |
| 2008/0242195 | A1 * | 10/2008 | Heinrich et al. | 451/6 |
| 2009/0124172 | A1 * | 5/2009 | Uchikura et al. | 451/36 |
| 2010/0015889 | A1 * | 1/2010 | Shimizu et al. | 451/5 |
| 2010/0130101 | A1 * | 5/2010 | Wang et al. | 451/8 |
| 2012/0021671 | A1 * | 1/2012 | McReynolds et al. | 451/6 |
| 2012/0293188 | A1 * | 11/2012 | Nikolenko | G01B 7/06 324/655 |

* cited by examiner

APPARATUS AND METHOD FOR CHEMICAL MECHANICAL POLISHING

BACKGROUND

Numerous integrated circuits are typically fabricated simultaneously on a single semiconductor wafer. At certain stages of fabrication, it is often necessary to polish a surface of the semiconductor wafer. In general, a semiconductor wafer is polished to remove high topography and surface defects, such as crystal lattice damage, scratches, roughness, or embedded particles of dirt or dust. This polishing process is often referred to as chemical mechanical planarization (CMP) and is utilized to improve the quality and reliability of semiconductor devices.

The conventional CMP process utilizes endpoint detection techniques or predetermined fixed-time polishing techniques to determine when to stop polishing. Both of these polishing stop techniques produce non-uniformities across the polished surface due to polishing rate variations. In addition, over-polishing, meaning excessive thinning of a functional layer, causes the functional layer to become too thin to be operated on. Thus, an improved composition or method for CMP processing is still in great demand.

BRIEF DESCRIPTION OF THE DRAWINGS

Aspects of the present disclosure are best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

A more complete understanding of the present disclosure may be derived by referring to the detailed description and claims when considered in connection with the Figures, where like reference numbers refer to similar elements throughout the Figures, and:

DETAILED DESCRIPTION OF THE INVENTION

Figure 1:
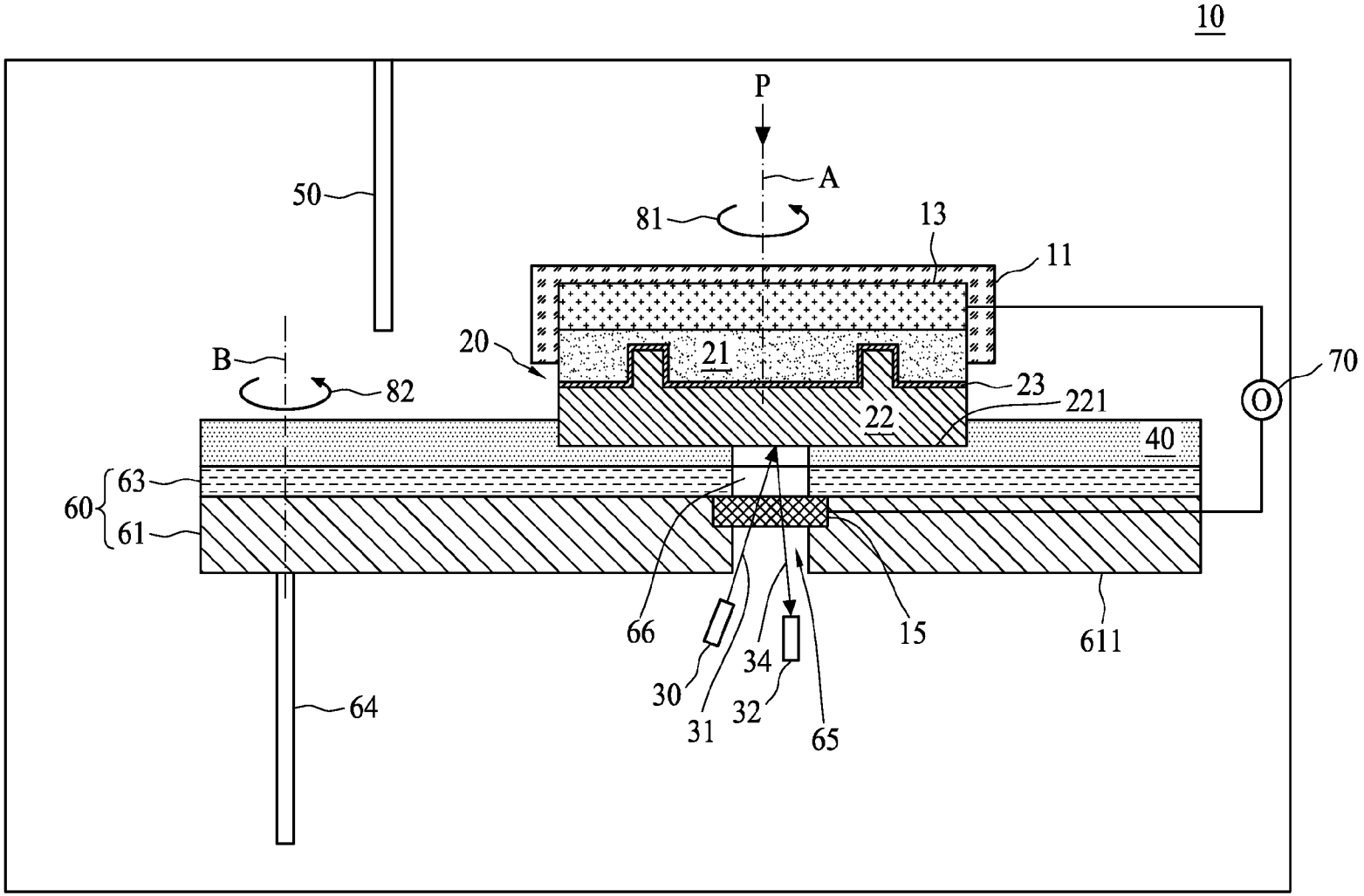
FIG. 1 is a schematic view of an apparatus including a wafer carrier, a rotatable pedestal, a platen, a polishing pad, a viewing window, and a light source according to some embodiments of the present disclosure.

The claimed subject matter is now described with reference to the drawings, wherein like reference numerals are generally used to refer to like elements throughout. In the following description, for purposes of explanation, numerous specific details are set forth in order to provide an understanding of the claimed subject matter. It is evident, however, that the claimed subject matter can be practiced without these specific details. In other instances, structures and devices are illustrated in block diagram form in order to facilitate describing the claimed subject matter.

Endpoint detection techniques are required to detect an optical reflection from an endpoint layer or a stop layer to avoid over-polishing. The optical reflection is sometimes too weak to be detected because a thickness of the endpoint layer is thinned for certain requirements. In the present disclosure, the endpoint layer is designed to convert a portion of energy of an incident light into a voltage or an electric current, where a detector is more sensitive than the optical reflection. Thus, by detecting the voltage or electric current, the polishing operation is accurately stopped so as to avoid over-polishing.

In various embodiments, an electrode is disposed adjacent to the endpoint layer and used to conduct the voltage or electric current to an electric current detector, which has a high sensitivity to a small amount of the voltage or electric current. Once the voltage or electric current is detected, the electric current detector sends a signal to stop or terminate the polishing operation immediately. By such design, over-polishing of the endpoint layer is avoided. In some embodiments, the surface of the endpoint layer transfers an electromagnetic wave into the voltage or electric current, and thus the voltage or electric current is not detected until a surface of the endpoint layer is exposed under the electromagnetic wave.

In describing and claiming the present disclosure, the following terminology will be used in accordance with the definitions set forth below.

As used herein, a "substrate" refers to a bulk substrate on which various layers and device structure are formed. In some embodiments, the bulk substrate includes silicon or a compound semiconductor, such as Ga As, InP, Si/Ge, or SiC. Examples of the layers include dielectric layers, doped layers, polysilicon layers, or conductive layers. Examples of the device structures include transistors, resistors, and/or capacitors, which are interconnected through an interconnect layer to additional integrated circuits. In some embodiments, the bulk substrate includes a wafer such as a polished wafer, an epi wafer, an argon anneal wafer, a hai wafer and a silicon on insulator (SOI) wafer.

As used herein, a "semiconductor substrate" refers to a chip carrier, which is generally manufactured using two complex manufacturing processes, i.e., front-end manufacturing, and back-end manufacturing, each involving potentially hundreds of steps. Front-end manufacturing involves the formation of a plurality of die on the surface of a semiconductor wafer. Each die is typically identical and contains circuits formed by electrically connecting active and passive components. Back-end manufacturing involves singulating individual die from the finished wafer and packaging the die to provide structural support and environmental isolation. Active electrical components, such as transistors, have the ability to control the flow of electrical current. Passive electrical components, such as capacitors, inductors, resistors, and transformers, create a relationship between voltage and current that is necessary to perform electrical circuit functions.

As used herein, "active and passive components" refers to components, which are formed on the surface of the semiconductor wafer by a series of process steps including doping, deposition, photolithography, etching, and planarization. Doping introduces impurities into the semiconductor material by techniques such as ion implantation or thermal diffusion. The doping process modifies the electrical conductivity of semiconductor material in active devices, transforming the semiconductor material into a permanent insulator, permanent conductor, or changing the way the semiconductor material changes in conductivity in response to an electric field. Transistors contain regions of varying types and degrees of doping arranged as necessary to enable the transistor to promote or restrict the flow of electrical current upon the application of an electric field.

Active and passive components are formed by layers of materials with different electrical properties. The layers are formed by a variety of deposition techniques determined in part by the type of material being deposited. For example, thin film deposition involves chemical vapor deposition (CVD), physical vapor deposition (PVD), electrolytic plating, and electroless plating processes. Each layer is generally patterned to form portions of active components, passive components, or electrical connections between components. The layers are patterned using photolithography, which involves the deposition of light sensitive material, e.g., photoresist, over the layer to be patterned. A pattern is transferred from a photomask to the photoresist using light. The portion of the photoresist pattern subjected to light is removed using a solvent, exposing portions of the underlying layer to be patterned. The remainder of the photoresist is removed, leaving behind a patterned layer. Alternatively, some types of materials are patterned by directly depositing the material into the areas or voids formed by a previous deposition/etch process using techniques such as electroless and electrolytic plating.

As used herein, "back-end manufacturing" refers to cutting or singulating the finished wafer into the individual die and then packaging the die for structural support and environmental isolation. To singulate the die, the wafer is scored and broken along non-functional regions of the wafer called saw streets or scribes. The wafer is singulated using a laser cutting device or saw blade. After singulation, the individual dies are mounted to a package substrate that includes pins or contact pads for interconnection with other system components. Contact pads formed over the semiconductor die are then connected to contact pads within the package. The electrical connections can be made with solder bumps, stud bumps, conductive paste, or wirebonds. An encapsulant or other molding material is deposited over the package to provide physical support and electrical isolation. The finished package is then inserted into an electrical system and the functionality of the semiconductor device is made available to the other system components.

As used herein, an "electrode" recited in the present disclosure is an electrical conductor used to make contact with a nonmetallic part of a circuit (e.g. a semiconductor, an electrolyte or a vacuum). In some embodiments, an electrode is referred to as either an anode or a cathode. The anode is now defined as the electrode at which electrons leave the cell and oxidation occurs, and the cathode as the electrode at which electrons enter the cell and reduction occurs. Each electrode becomes either the anode or the cathode depending on the direction of current through the cell. In some embodiments, a bipolar electrode is an electrode that functions as the anode of one cell and the cathode of another cell.

As used herein, a "slurry" recited in the present disclosure is a watery mixture of insoluble matter. The insoluble matter includes abrasive particles and certain functional particles in accordance with features of embodiments.

As used herein, an "abrasive particle" recited in the present disclosure is an object dispersed in acidic or basic solution. The abrasive particles have a size distribution which directly affects critical metrics, including rate of removal and wafer defects. Particle size analysis is therefore a key indicator of CMP slurry performance. In some embodiments, the typical size range of the abrasive particles is about 50 nanometers to about 175 nanometers and several particle sizing techniques are capable of measuring in this range with varying accuracy and precision.

As used herein, a "film" recited in the present disclosure is an object deposited on an endpoint layer. In some embodiments, the film is consisting of a group selected from oxide, metal oxide, nitride, phosphosilicate glass (PSG), tetra-ethyl-ortho-silicate (TEOS) oxide, Black Diamond® (Applied Materials of Santa Clara, Calif.), amorphous fluorinated carbon, low-k dielectric materials and borophosphosilicate glass (BPSG). Examples of the oxide are selected from silicon dioxide ($SiO_2$) and phosphorus pentoxide ($P_4O_{10}$), selenium dioxide ($SeO_2$), sulfur trioxide ($SO_3$). Examples of the metal oxide are selected from zinc oxide (ZnO), aluminium oxide ($Al_2O_3$), iron (II,III) oxide ($Fe_3O_4$), calcium oxide (CaO), ruthenium tetroxide ($RuO_4$), osmium (VIII) oxide ($OsO_4$), iridium tetroxide ($IrO_4$), indium tin oxide ($In_2O_3$:$SnO_2$), xenon tetroxide ($XeO_4$), nickel oxide, titanium oxide, hafnium oxide, zirconium oxide, tungsten oxide, tantalum oxide, molybdenum oxide and copper oxide. Examples of the nitride are selected from silicon nitride ($Si_3N_4$), titanium nitride (TiN), silicon oxynitride ($Si_2N_2O$), thallium (I) nitride ($Tl_3N$), magnesium nitride ($Mg_3N_2$), beryllium nitride ($Be_3N_2$), calcium nitride ($Ca_3N_2$) and strontium nitride ($Sr_3N_2$).

As used herein, an "electric current detector" recited in the present disclosure is a device or module that detects electrical current (AC or DC) in a circuit, and generates a signal proportional to the electrical current. The generated signal could be analog voltage or current or even digital output. In some embodiments, the signal is then utilized to display the measured current in an ammeter or is stored for further analysis in a data acquisition system or is utilized for control purposes.

As used herein, a "light source" recited in the present disclosure is an object emitting a certain kind of electromagnetic radiation in a visible spectrum or a non-visible spectrum. The electromagnetic radiation is selected, but not limited, from a group consisting of chemoluminescence, fluorescence, phosphorescence, cathodoluminescence, electron stimulated luminescence. In certain embodiments, the light source is a 325 nm He—Cd laser.

As used herein, a "through hole" recited in the present disclosure is a hole that is reamed, drilled, milled etc., completely through a substrate. In some embodiments, a through hole is a hole that goes all the way through the substrate. In certain embodiments, there is an object disposed in the through hole so as to form a blind hole, which does not go all the way through the substrate.

In some embodiments, as in FIG. 1, an apparatus 10 for chemical mechanical polishing (CMP) of a workpiece or semiconductor substrate 20 includes a patterned base layer 21, a film 22 and a metal containing layer 23. The patterned base layer 21 is formed for the subsequent formation of metal lines, contact/via studs, and/or pads. The metal containing layer 23 acts as an endpoint layer and is compliant to the morphology of the patterned base layer 21. The film 22 is disposed on the metal containing layer 23 and configured to cover the metal containing layer 23. In certain embodiments, it should be noted that the semiconductor substrate 20 has been preprocessed and therefore includes layers of interleaved circuitry. For simplicity, the other features are not represented in FIG. 1.

In some embodiments, the apparatus 10 includes a wafer carrier 11 including a suitable means for securing the semiconductor substrate 20 thereto. As shown in FIG. 1, the semiconductor substrate 20 is positioned between the wafer carrier 11 and a rotatable pedestal 60. The wafer carrier 11 is intended to be mounted by a suitable means above the rotatable pedestal 60 for rotation along an axis A in a direction indicated by an arrow 81. The wafer carrier 11 is configured to be positionable between a polishing position and a non-polishing position by a suitable control means (not shown) according to a start/stop signal. In the polishing position, the wafer carrier 11 is positioned so that a polishing surface 221 is in polishing contact with a polishing pad 63 of the rotatable pedestal 60, and further, the wafer carrier 11 exerts an appropriate pressure P upon the polishing pad 63. In the non-polishing position, the wafer carrier 11 is positioned so that the polishing surface 221 is moved away from the polishing pad 63, thereby effectively terminating the polishing operation.

In some embodiments, a first electrode 13 is disposed at the wafer carrier 11, including a suitable means for securing the first electrode 13 adjacent to the semiconductor substrate 20. Since the first electrode 13 is electrically coupled to an electric current detector 70, the first electrode 13 is able to transmit an electric signal between the semiconductor substrate 20 and the electric current detector 70. In certain embodiments, the first electrode 13 includes, but is not limited to, aluminum (Al), chromium (Cr), gold (Au), molybdenum (Mo), platinum (Pt), tantalum (Ta), titanium (Ti), silver (Ag), copper (Cu), tungsten (W), $RuO_2$ or a combination thereof.

In some embodiments, the rotatable pedestal 60 includes a platen 61 and the polishing pad 63. The rotatable pedestal 60 is disposed opposite to the wafer carrier 11 in order to perform the polishing operation as previously discussed. The polishing pad 63 has a thickness on the order of 50 mils (1 mil=0.001 inches). The rotatable pedestal 60 rotates via a pedestal spindle 64 and a corresponding electrically controllable motor (not shown), at an axis B in a direction indicated by an arrow 82.

Referring to FIG. 1, the rotatable pedestal 60 further includes a viewing window 66 embedded within the polishing pad 63 at a prescribed location. The viewing window 66 is configured to enable in-situ viewing of the polishing surface 221 of the semiconductor substrate 20 during polishing. In some embodiments, the viewing window 66 allows viewing of the polishing surface 221 from an underside 611 of the rotatable pedestal 60 upon the viewing window 66. Though there is one viewing window 66 shown in the drawing, more than one viewing window may be included.

In some embodiments, a second electrode 15 is disposed at the rotatable pedestal 60. As shown in FIG. 1, the second electrode 15 is disposed under the viewing window 66, which is made with electric conductivity materials, and hence an electric current is able to transmit to the second electrode 15 through the viewing window 66.

The rotatable pedestal 60 further includes a first through hole 65. The viewing window 66 and the second electrode 15 are disposed in the first through hole 65. Because the second electrode 15 and the viewing window 66 are transparent, a light beam 31 from a light source 30 is able to pass therethrough. The second electrode 15 is a transparent electrode including indium tin oxide (ITO), fluorine doped tin oxide (FTO), indium zinc oxide (IZO), poly(3,4-ethylenedioxythiophene) (PEDOT) or aluminium zinc oxide (AZO). Thus, the second electrode 15 is transparent to a light beam 31 emitting toward the wafer carrier 11. In certain embodiments, the first electrode 13 is an opaque electrode, which includes, but is not limited to, aluminum (Al), chromium (Cr), gold (Au), molybdenum (Mo), platinum (Pt), tantalum (Ta), titanium (Ti), silver (Ag), copper (Cu), tungsten (W), $RuO_2$ or a combination thereof.

Figure 2:
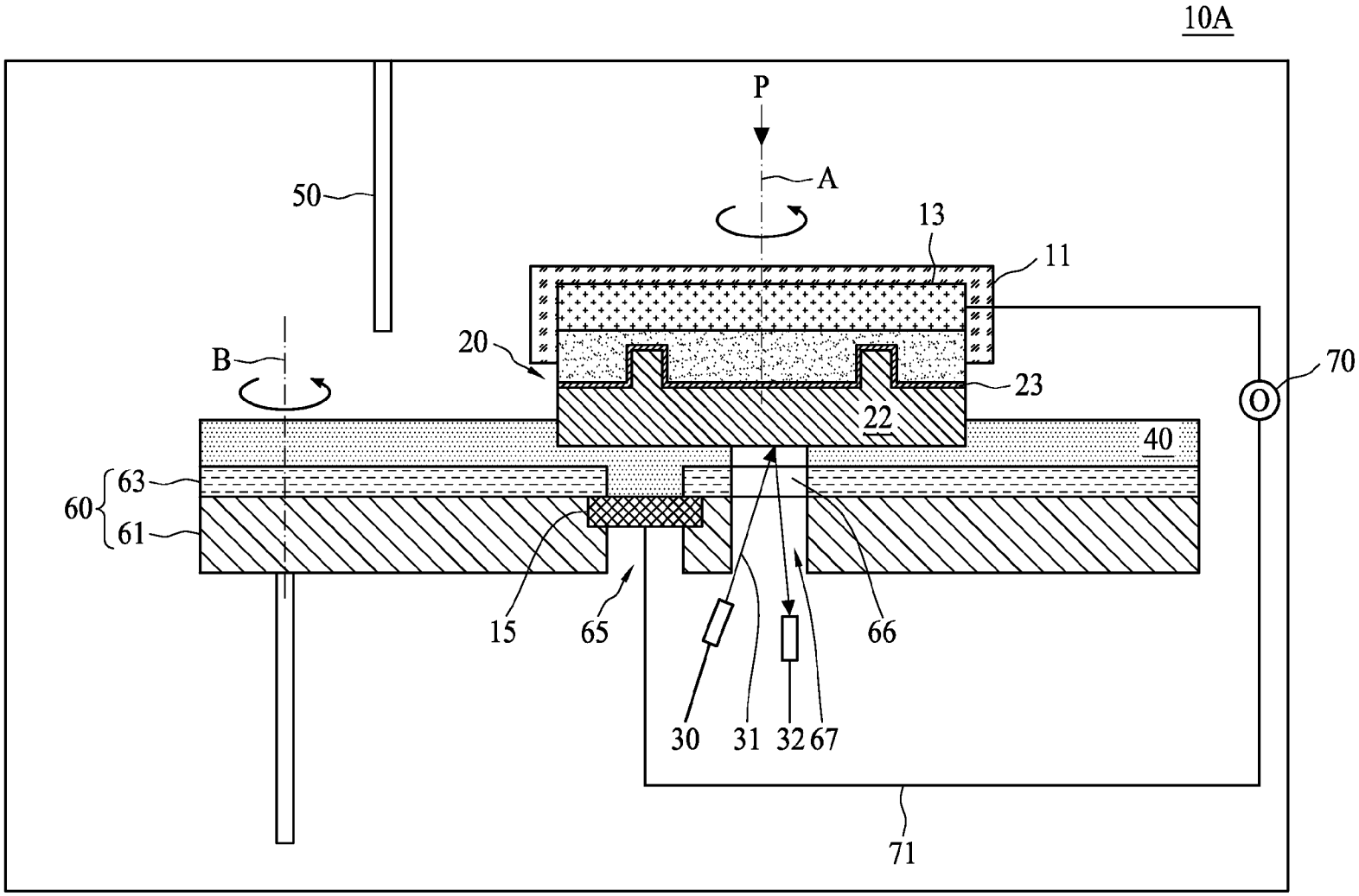
FIG. 2 is a schematic view of an apparatus including a wafer carrier, a rotatable pedestal, a platen, a polishing pad, a viewing window, and a light source according to certain embodiments of the present disclosure.

In some embodiments as shown in FIG. 2, the rotation pedestal 60 of the apparatus 10A further includes a second through hole 67. The viewing window 66 is disposed in the second through hole 67 in order to pass the light beam 31 therethrough and toward the wafer carrier 11. The second electrode 15 is disposed in the first through hole 65 and blocks an outlet of the first through hole 65. Because the second electrode 15 is not necessarily designed to allow the light beam 31 to pass through, the second electrode 15 is an opaque electrode, which includes aluminum (Al), chromium (Cr), gold (Au), molybdenum (Mo), platinum (Pt), tantalum (Ta), titanium (Ti), silver (Ag), copper (Cu), tungsten (W), $RuO_2$ or a combination thereof. In addition, the first through hole 65 accommodates a conducting wire 71, which is electrically connected with the second electrode 15 and the electric current detector 70. Thus, the second electrode 15 is electrically coupled with the electric current detector 70.

Figure 3:
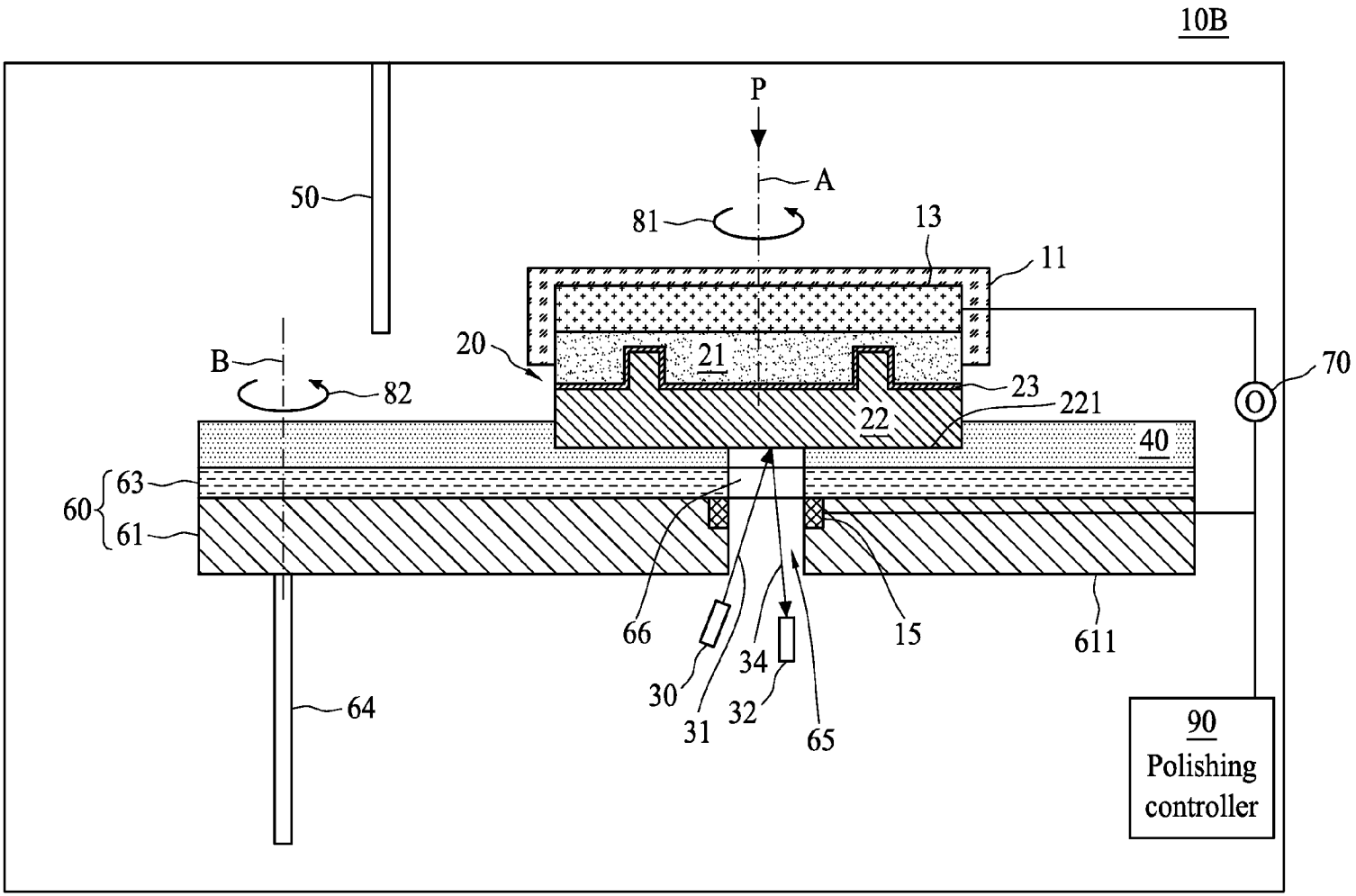
FIG. 3 is a schematic view of an apparatus including a wafer carrier, a rotatable pedestal, a platen, a polishing pad, a viewing window, and a light source according to other embodiments of the present disclosure.

In some embodiments as shown in FIG. 3, the first through hole 65 of the apparatus 10B is surrounded by the second electrode 15. Since the viewing window 66 is an electrically conductive material, the second electrode 15 receives the electric current through the viewing window 66 and transmits the electric current to the electric current detector 70. The first electrode 13 is also electrically coupled with the electric current detector 70. Thus, the second electrode 15 is electrically coupled with the first electrode 13 so as to form a circuit loop therebetween.

In some embodiments as shown in FIG. 3, the electric current detector 70 is disposed between the first electrode 13 and the second electrode 15. In other words, the electric current detector 70 is within the circuit loop formed by the first electrode 13 and the second electrode 15. In certain embodiments, the apparatus 10B further includes a polishing controller 90, which is electrically coupled with the circuit loop. The polishing controller 90 is used to generate the start/stop signal for the polishing operation in accordance with the signal from the electric current detector 70.

In some embodiments as in FIG. 3, the apparatus 10B further includes a detector 32, and the light source 30 is configured to emit the light beam 31 at a prescribed incident angle for transmission of the light beam 31 through the viewing window 66 toward the wafer carrier 11 during polishing of the semiconductor substrate 20. The detector 32 is configured to detect reflected light beam 34 bounced from the metal containing layer 23 and penetrating back through the viewing window 66 and the second electrode 15. A wavelength of the light beam 31 is from about 10 nm to about 390 nm. In certain embodiments, the wavelength of the light beam 31 is from about 25 nm to about 260 nm. In other embodiments, the wavelength of the light beam 31 is from about 125 nm to about 225 nm. In some other embodiments, the wavelength of the light beam 31 is from about 35 nm to about 139 nm.

In some embodiments, the apparatus 10B includes a tube 50 for dispensing a polishing slurry 40. The slurry 40 is used to flow over the polishing pad 63 and includes several abrasive particles (not shown) for grinding and flushing away unwanted film material, and is to be further discussed below.

Figure 4:
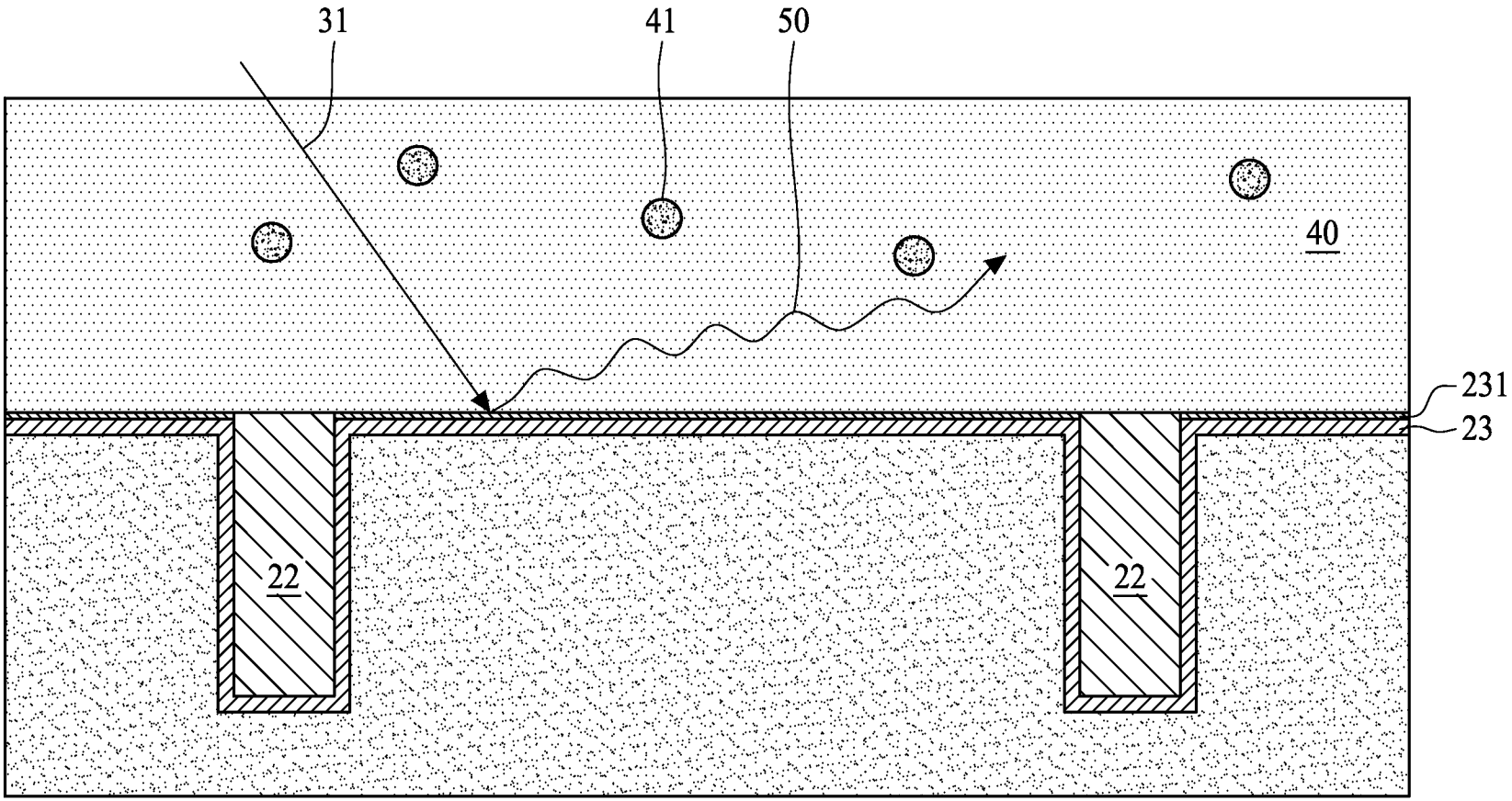
FIG. 4 is a cross-sectional view of a composition including abrasive particles of a slurry, wherein the abrasive particles are grinding upon the metal containing layer according to some embodiments of the present disclosure.

In some embodiments as in FIG. 4, the slurry 40 for chemical mechanical polishing includes abrasive particles 41. A diameter of the abrasive particles 41 is adjusted from about 50 nm to about 95 nm, according to a thickness of the film 22. In certain embodiments, the diameter of the abrasive particles 41 ranges from about 25 nm to about 77 nm. In other embodiments, the diameter of the abrasive particles 41 ranges from about 10 nm to about 82 nm. In still other embodiments, the diameter of the abrasive particles 41 ranges from about 31 nm to about 175 nm.

In some embodiments, the proportion of weight of the abrasive particles 41 to the total weight of the slurry 40 is adjusted according to the property of the film 22. In some embodiments, the abrasive particles 41 are from about 1% to about 3% of the slurry 40 by weight. In certain embodiments, the abrasive particles 41 are from about 2.5% to about 7% of the slurry 40 by weight. In other embodiments, the abrasive particles 41 are from about 4% to about 10% of the slurry 40 by weight. In still other embodiments, the abrasive particles 41 are from about 5% to about 9% of the slurry 40 by weight.

In some embodiments as in FIG. 4, the metal containing layer 23 further includes a native oxide layer 231, which is much thinner than the metal containing layer 23. In other words, the metal containing layer 23 includes oxygen. A thickness of the metal containing layer 23 is from about 10 Å to about 20 Å, while the native oxide layer 231 is from about 1 Å to about 2 Å. In certain embodiments, the metal containing layer 23 is from about 14 Å to about 28 Å A, while the native oxide layer 231 is from about 1.2 Å to about 2.1 Å. In other embodiments, the metal containing layer 23 is from about 21 Å to about 36 Å, while the native oxide layer 231 is from about 1.4 Å to about 2.3 Å. In still other embodiments, the metal containing layer 23 is from about 32 Å to about 50 Å, while the native oxide layer 231 is from about 1.9 Å to about 3 Å.

In some embodiments, the metal containing layer 23 also includes titanium nitride (TiN) or tantalum nitride (TaN) and the native oxide layer 231 is disposed thereon. The native oxide layer 231 includes has an energy gap, which refers to the energy difference between the top of the valence band and the bottom of the conduction band in the native oxide layer 231. The light beam 31 emitting on the native oxide layer 231 has a specific wavelength provides an energy to be absorbed by the native oxide layer 231. Once the energy provided by the light beam 31 is greater than the energy gap, a photoelectric effect is triggered in the native oxide layer 231. As in FIG. 4, the incident light beam 31 is absorbed by the native oxide layer 231 such that electrons in the native oxide 231 are emitting into slurry 40 to form electric current 50. Therefore, the electric current 50 is an indicator to measure exposure of the native oxide layer 231.

Referring back to FIGS. 1 to 3, the electric current 50 flows in the circuit loop between electrodes 13 and 15. The electric current detector 70 between electrodes 13 and 15 is used to gauge the magnitude of the electric current 50. The magnitude of the electric current 50 is used to manage subsequent polishing operation. In some embodiments, the polishing operation is terminated once an electric current is detected by the electric current detector 70. In some embodiments, the polishing operation is terminated when the magnitude of the electric current 50 is greater than a threshold value.

Through the electric current detection, over-polishing can be avoided. In some embodiments, the wafer carrier 11 is in the polishing position until an electric current 50 is detected by the current detector 70. The film 22, which has a different band gap from the native oxide 231, is unresponsive to the light beam 31. Thus, once the metal containing layer 23 is exposed under the light beam 31 with the specific wavelength after the semiconductor substrate 20 underwent a polishing operation, the polishing operation is terminated so as to avoid over-polishing on the metal containing layer 23. The specific wavelength is from about 10 nm to about 390 nm. In certain embodiments, the wavelength of the light beam 31 is from about 25 nm to about 260 nm. In other embodiments, the wavelength of the light beam 31 is from about 125 nm to about 225 nm. In some other embodiments, the wavelength of the light beam 31 is from about 35 nm to about 139 nm.

A method for chemical mechanical polishing is used to detect the electric current from the metal containing layer so as to prevent over-polishing. The method includes a number of operations and the description and illustrations are not deemed as a limitation as to the order of the operations.

A term "depositing" or "deposited" is used in the present disclosure to describe an operation of locating materials on a substrate using a vapor phase of a material to be deposited, a precursor of the material, an electrochemical reaction, or sputtering/reactive sputtering. The depositing operation includes various steps and processes and varies in accordance with the features of the embodiments. In some embodiments, depositions using a vapor phase of a material include any operations such as, but not limited to, chemical vapor deposition (CVD) and physical vapor deposition (PVD). Examples of vapor deposition methods include hot filament CVD, rf-CVD, laser CVD (LCVD), conformal diamond coating operations, metal-organic CVD (MOCVD), thermal evaporation PVD, ionized metal PVD (IMPVD), electron beam PVD (EBPVD), reactive PVD, atomic layer deposition (ALD), plasma enhanced CVD (PECVD), high density plasma CVD (HDPCVD), low pressure CVD (LPCVD), and the like. Examples of deposition using an electrochemical reaction include electroplating, electroless plating, and the like. Other examples of deposition include pulse laser deposition (PLD), and atomic layer deposition (ALD).

A term "oxidizing" or "oxidized" is used in the present disclosure to describe an operation of incorporating one oxygen atom into a chemical compound with other elements. The oxidizing operation includes various steps and processes and varies in accordance with the features of embodiments. In certain embodiments, the oxidizing operation includes forming stable chemical bonds with the object. For instance, the oxidation uses oxygen, within a temperature from about 1000° C. to about 1200° C., within about 200 sec to about 400 sec (about 50 CC to about 100 CC) in the substrate. A high and a low temperature are traded off for a short duration and a long duration for the operation, respectively.

A term "dispensing" or "dispensed" is used in the present disclosure to describe an operation of delivering a stream of slurry or composition to an object. The distributing operation includes various steps and processes and varies in accordance with the features of the embodiments. In some embodiments, the distributing operation includes stirring the stream of small drops of slurry or composition in the air.

A term "retaining" or "retained" is used in the present disclosure to describe an operation of keeping an object from being abraded or worn. The retaining operation includes various steps and processes and varies in accordance with the features of embodiments. In some embodiments, the retaining operation avoids unnecessary polishing on the object.

Figure 5:
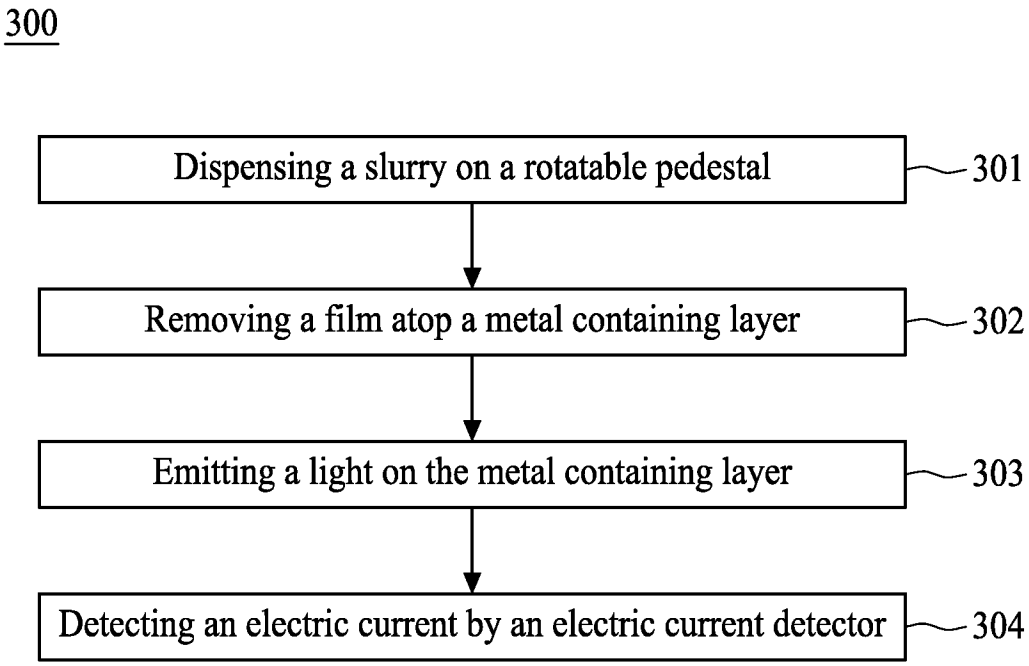
FIG. 5 is a flowchart of a method for dispensing a slurry on a semiconductor substrate and removing a film from the semiconductor substrate according to some embodiments of the present disclosure.

FIG. 5 is a diagram of a method 300 for chemical mechanical polishing in accordance with some embodiments of the present disclosure. The method 300 includes several operations, which are discussed in detail with reference to FIGS. 6 to 7. At operation 301, a slurry is dispensed on a pad of a rotatable pedestal for performing a grinding operation on a semiconductor substrate including a metal containing layer and a film atop the metal containing layer. At operation 302, the film atop the metal containing layer is removed, thereby exposing the metal containing layer. At operation 303, a light is emitted on the metal containing layer for converting a portion of energy of the light into an electric current. At operation 304, the electric current is detected by the electric current detector.

Figure 6:
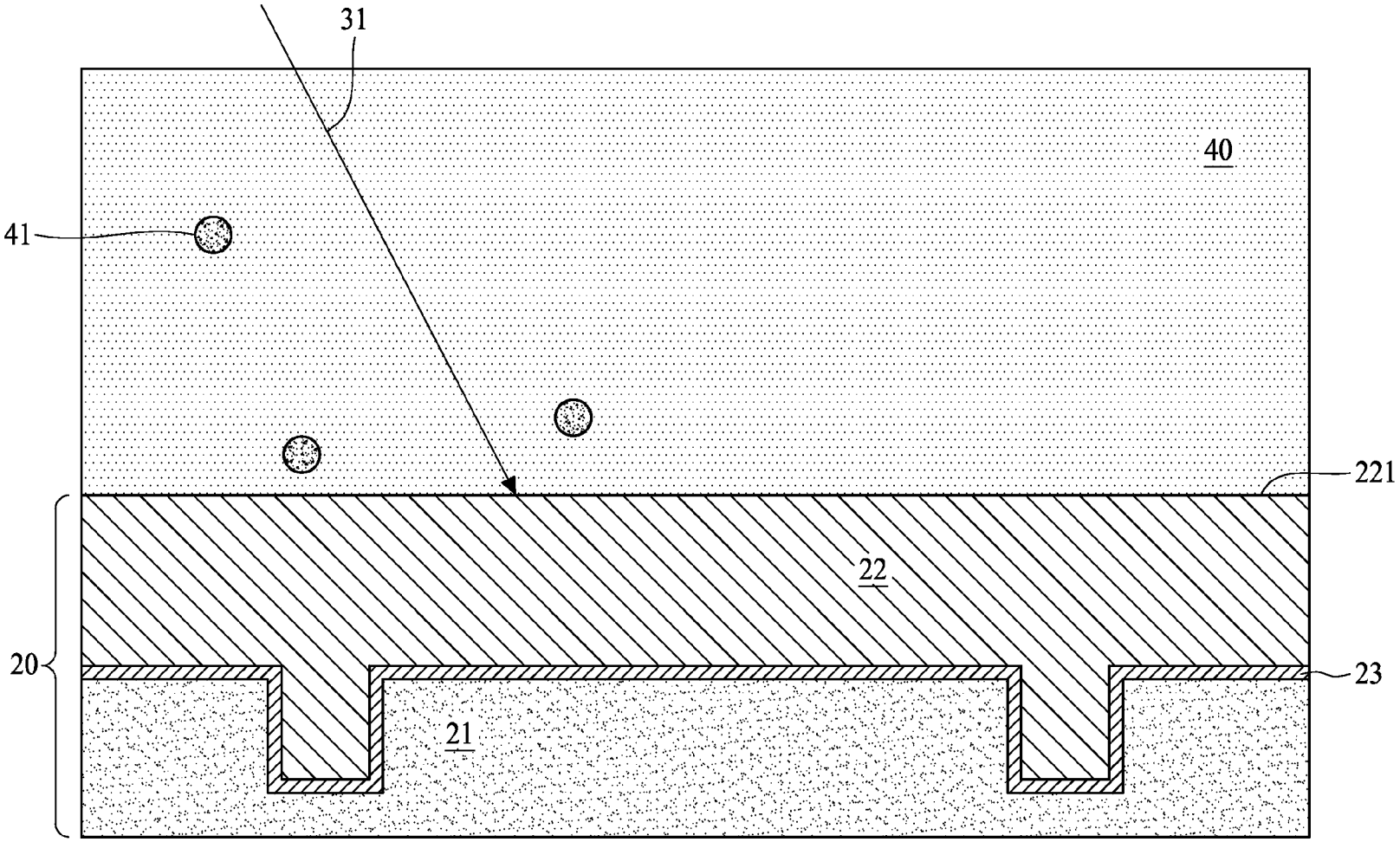
FIG. 6 is a cross-sectional view of a semiconductor substrate ground by abrasive particles in a slurry in accordance with some embodiments of the present disclosure.
Figure 7:
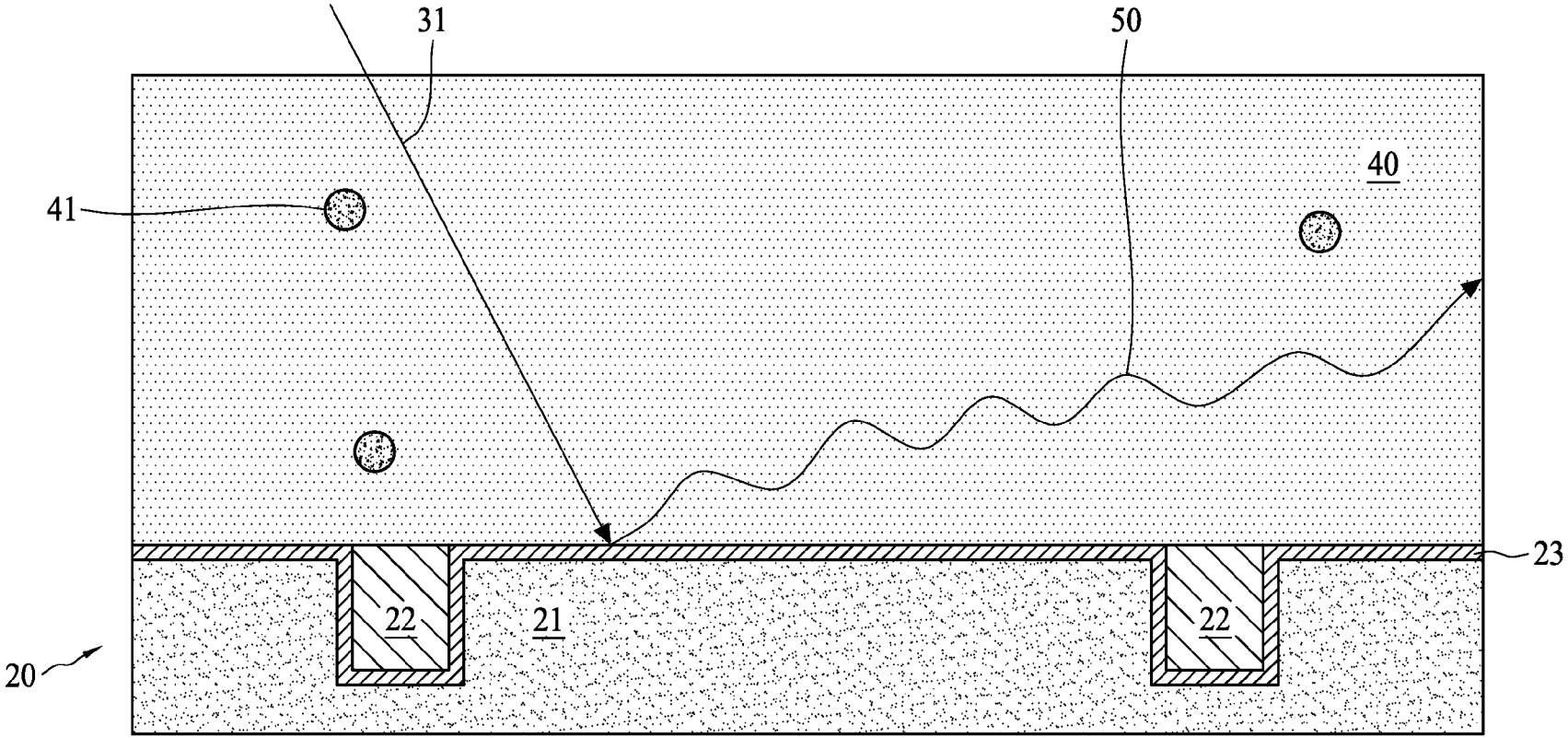
FIG. 7 is a cross-sectional view of a portion of the film atop the metal containing layer that is polished or grinded so as to allow a light beam to emit on the surface of the metal containing layer in accordance with some embodiments of the present disclosure.

FIGS. 6 to 7 have been simplified for a better understanding of the inventive concepts of the present disclosure. In FIGS. 6 to 7, elements with the same labeling numbers as those in FIGS. 1 to 4 are previously discussed with reference thereto and are not repeated here for simplicity.

Referring to FIG. 1, the slurry 40 is dispensed on the rotatable pedestal 60. While the polishing pad 63 polishes or contacts the semiconductor substrate 20, the slurry 40 including abrasive particles 41 is disposed between the polishing pad 63 and the film 22 of the semiconductor substrate 20. In other words, the abrasive particles 41 are above the film 22 as shown in FIG. 6 in order to perform a grinding operation against the polishing surface 221 of the semiconductor substrate 20. In some embodiments as in FIG. 6, several abrasive particles 41 grind the film 22 so as to reduce the thickness of the film 22 during the polishing operation as previously discussed. In certain embodiments, the semiconductor substrate 20 includes several dies, where each of which has active and passive devices using semiconductor manufacturing processes described above.

Referring to FIG. 7, a major portion of the film 22 is removed from the semiconductor substrate 20. In particular, the film 22 is polished by the polishing pad 63 as shown in FIG. 1 and then the abrasive particles 41 grind and remove unwanted film 22 residue, thereby exposing the metal containing layer 23. Once the metal containing layer 23 is exposed and is accessible to the light beam 31, the electric current 50 is generated by the metal containing layer 23.

In FIG. 7, the light beam 31 is emitted toward the semiconductor substrate 20. A portion of energy from the light beam 31 is converted by the metal containing layer 23 into an electric current, which is detected by the electric current detector 70. The metal containing layer 23 receives the light beam 31 with a predetermined wavelength, which is from about 10 nm to about 390 nm. In certain embodiments, the wavelength of the light beam 31 is from about 25 nm to about 260 nm. In other embodiments, the wavelength of the light beam 31 is from about 125 nm to about 225 nm. In some other embodiments, the wavelength of the light beam 31 is from about 35 nm to about 139 nm.

Referring back to FIG. 3, when the signal from the electric current detector 70 is transmitted to the polishing controller 90, the polishing controller 90 compares the signal to a threshold value. In some embodiments, the threshold value is 0.1 mA. Once the polishing controller 90 confirms that the value of the electric current is greater than the threshold value, the polishing controller 90 immediately sends the stop signal to the wafer carrier 11 so as to locate the wafer carrier 11 in the non-polishing position.

Figure 8:
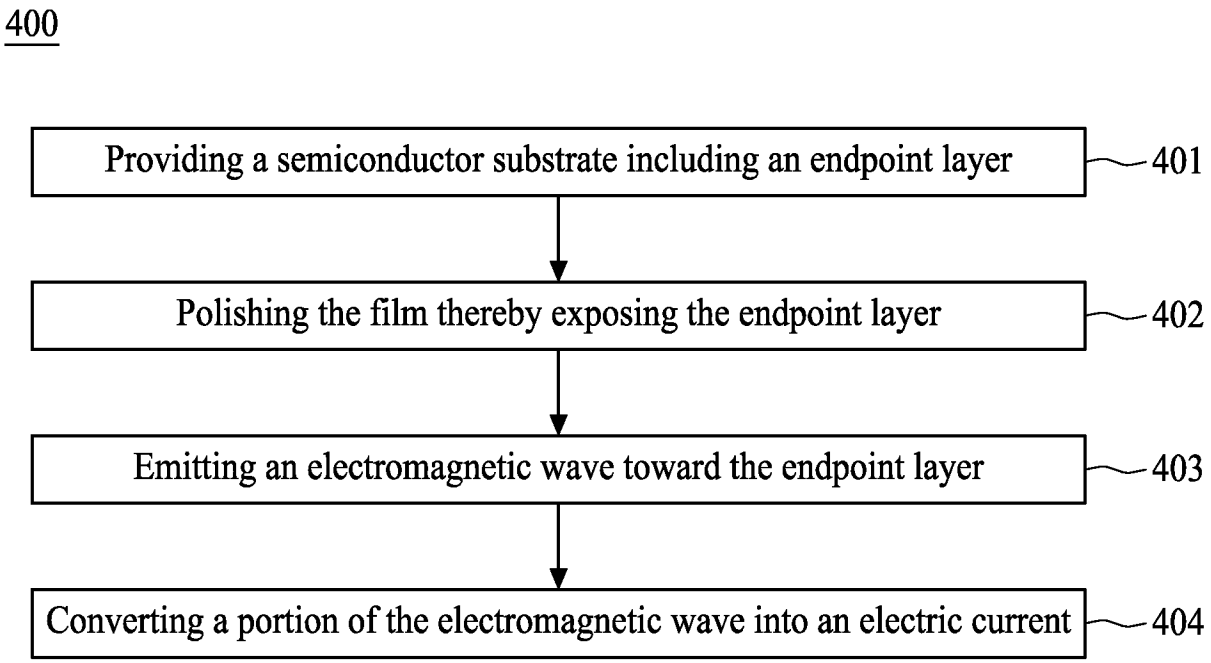
FIG. 8 is a flowchart of a method for providing a semiconductor substrate including a metal containing layer, and exposing the metal containing layer to an oxygen-containing ambient condition in accordance with some embodiments of the present disclosure.

FIG. 8 is a diagram of a method 400 for chemical mechanical polishing in accordance with some embodiments of the present disclosure. The method 400 includes several operations, which are discussed in detail with reference to FIGS. 9 to 12. At operation 401, a semiconductor substrate including an endpoint layer with a film is provided. At operation 402, the film is polished, thereby exposing the endpoint layer. At operation 403, an electromagnetic wave is emitted toward the endpoint layer. At operation 404, a portion of the electromagnetic wave is converted into an electric current by the endpoint layer.

FIGS. 9 to 12 have been simplified for a better understanding of the inventive concepts of the present disclosure. In FIGS. 9 to 12, elements with the same labeling numbers as those in FIGS. 1 to 4 are previously discussed with reference thereto and are not repeated here for simplicity.

Figure 9:
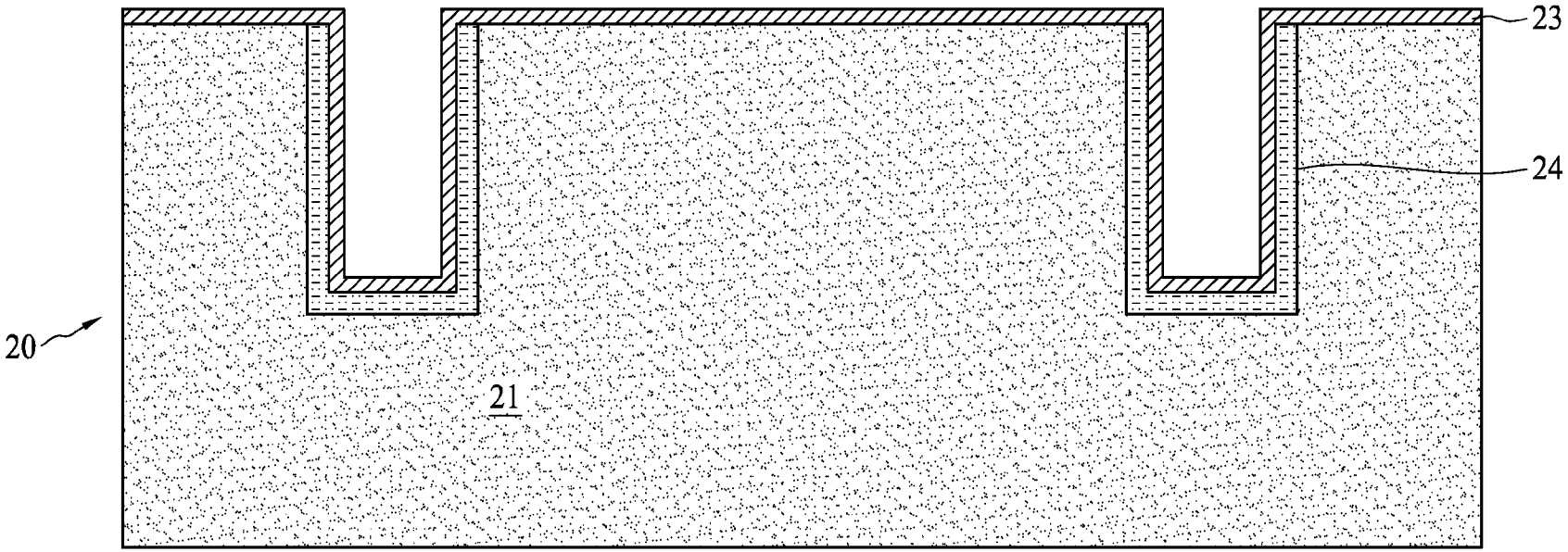
FIG. 9 is a cross-sectional view of providing a semiconductor substrate including a patterned base layer, the metal containing layer, and a preprocessed layer in accordance with some embodiments of the present disclosure.

Referring to FIG. 9, a semiconductor substrate 20 is provided and includes the patterned base layer 21, the endpoint layer or the metal containing layer 23 and a preprocessed layer/layers 24.

Figure 10:
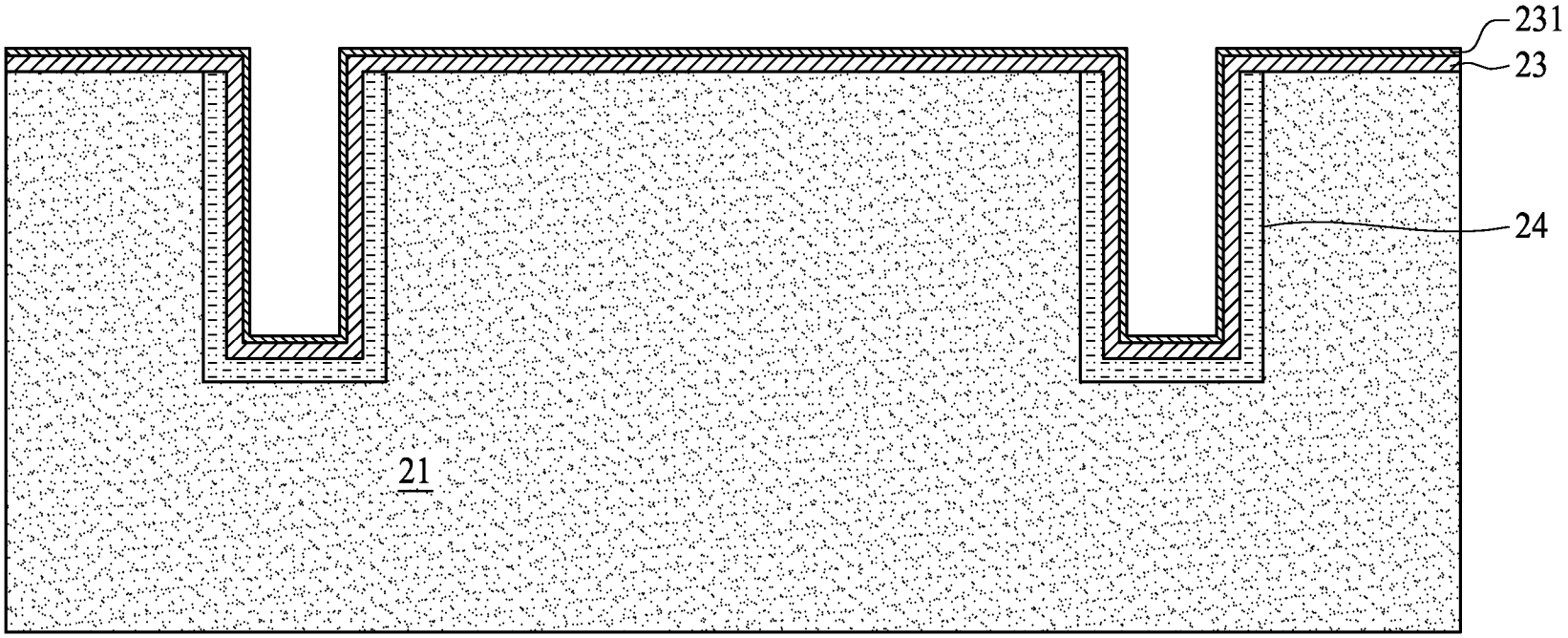
FIG. 10 is a cross-sectional view of exposing a semiconductor substrate including the patterned base layer, the metal containing layer, and the preprocessed layer under an oxygen-containing ambient condition in accordance with some embodiments of the present disclosure.

Referring to FIG. 10, the end point layer or the metal containing layer 23 is exposed under an oxygen-containing ambient condition which oxidizes a surface of the metal containing layer 23 to form a native oxide layer 231. In some embodiments, the pressure of the oxygen-containing ambient condition affects the thickness of the native oxide layer 231. In some embodiments, the pressure of the oxygen-containing ambient condition is between about 14 psi and about 29 psi. In certain embodiments, the pressure is between about 11 psi and about 32 psi. In other embodiments, the pressure is between about 17 psi and about 42 psi. In still some embodiments, the pressure is between about 9 psi and about 38 psi.

Figure 11:
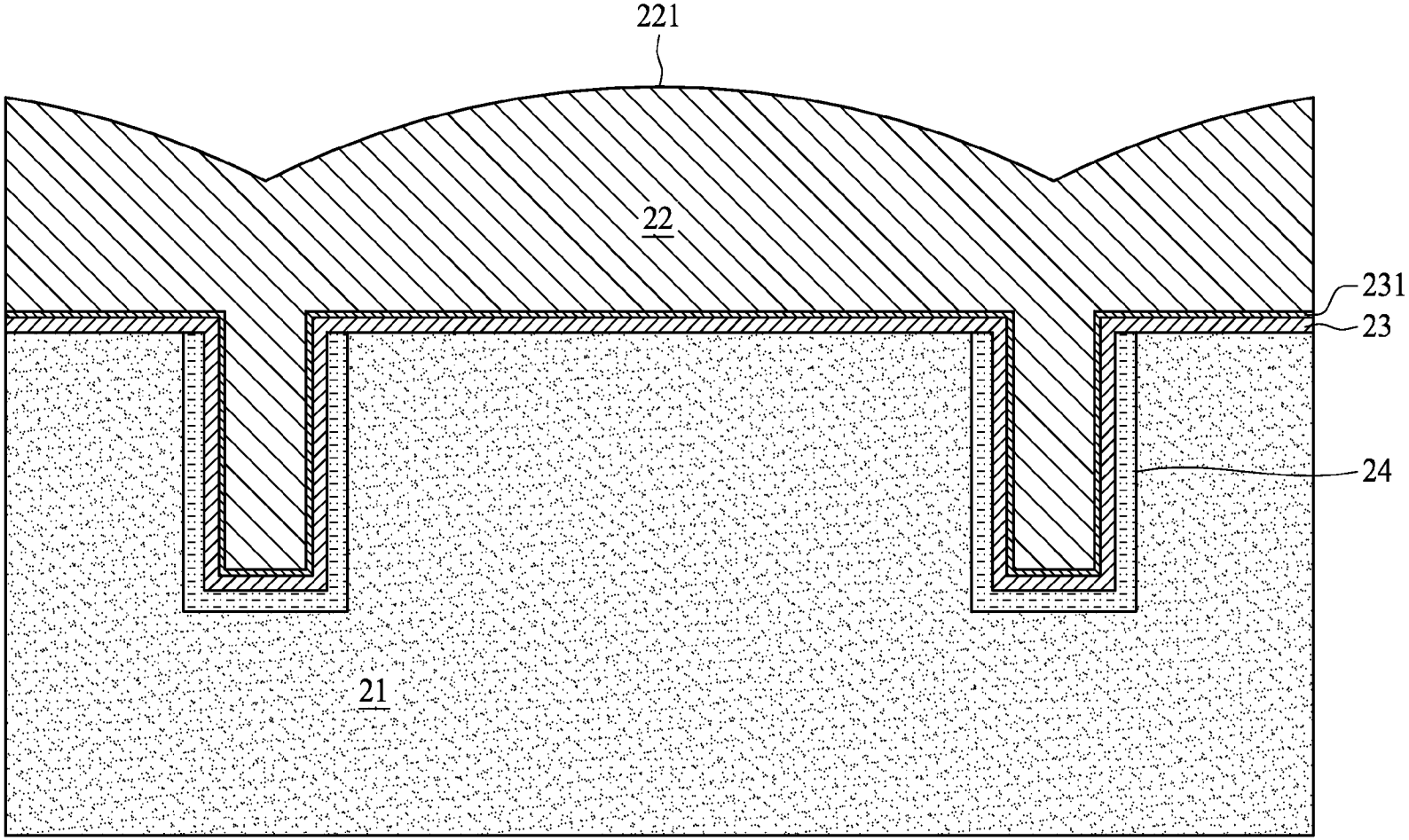
FIG. 11 is a cross-sectional view of depositing a film on a semiconductor substrate including the patterned base layer, the metal containing layer, and the preprocessed layer in accordance with some embodiments of the present disclosure.

Referring to FIG. 11, a film 22 is deposited on the native oxide layer 231 and the metal containing layer 23. The film 22 includes a topographic surface or the polishing surface 221, which is further polished by the polishing pad 63 shown in FIG. 1 and grinded by the abrasive particles 41 of the slurry 40.

Figure 12:
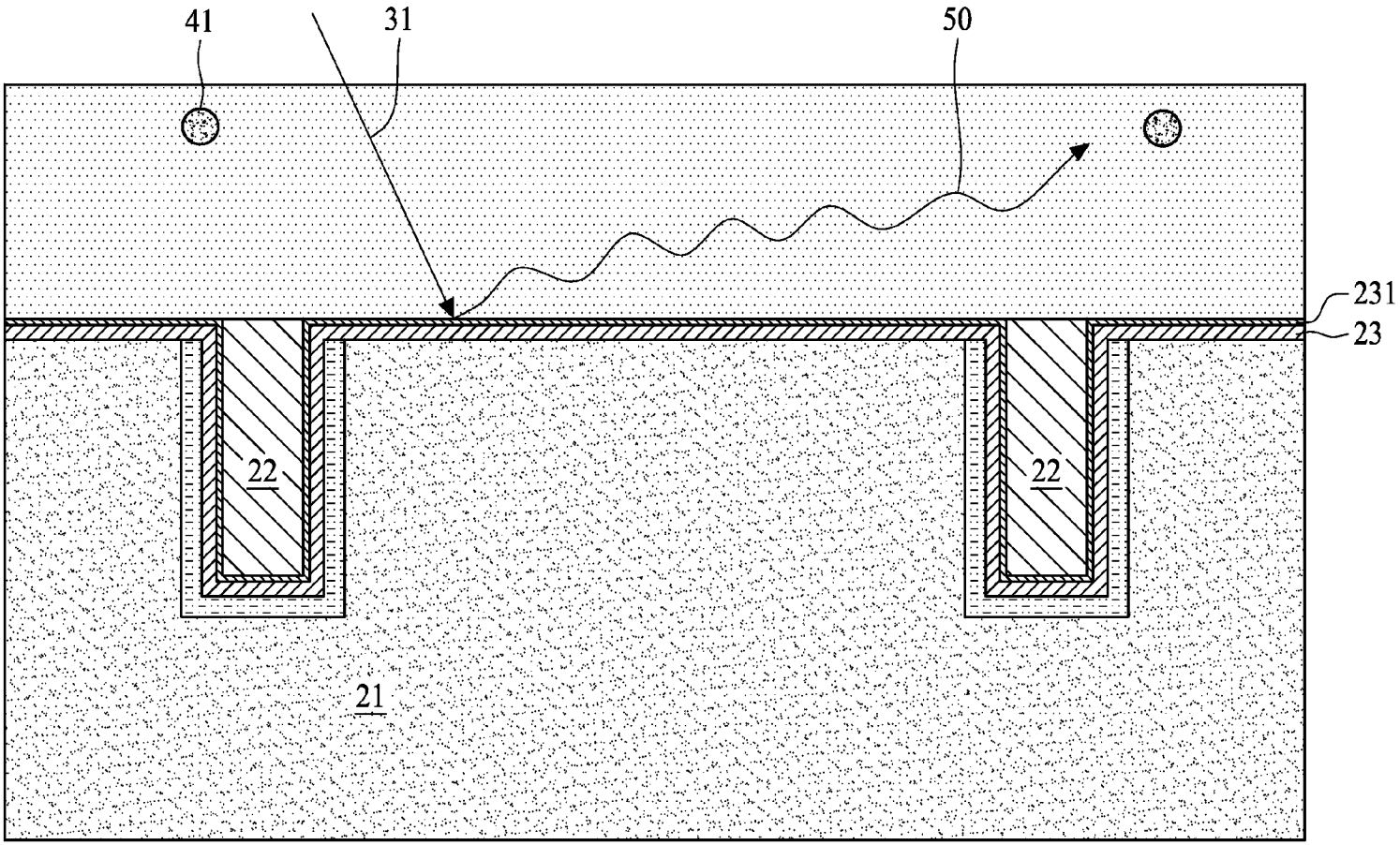
FIG. 12 is a cross-sectional view of polishing a film on a semiconductor substrate including the patterned base layer, the metal containing layer, and the preprocessed layer, thereby exposing the metal containing layer in accordance with some embodiments of the present disclosure.

Referring to FIG. 12, the film 22 is polished, thereby exposing the endpoint layer or the metal containing layer 23 with the native oxide layer 231. In some embodiments, the native oxide layer 231 has a band gap, which is smaller than the energy of the light beam 31 or electromagnetic wave with a wavelength smaller than about 390 nm, and hence the electrons are able to move freely within the native oxide layer 231. In other words, a portion of energy of the light beam 31 or electromagnetic wave is converted into free electrons or the electric current 50 through the native oxide layer 231. Thus, as more area of the film 22 is polished or as the metal containing layer 23 becomes more exposed under the electromagnetic wave being emitting toward the endpoint layer, the value of the electric current 50 from the oxidized surface or the native oxide layer 231 increases. Once the value of the electric current 50 is greater than the threshold value, the polishing operation is switched to the non-polishing operation so as to avoid over-polishing. In other words, the endpoint layer is retained by comparing the value of the electric current to the threshold value, which is about 0.1 mA.

In some embodiments, each of the abrasive particles 41 further includes a metallic body. The metallic body includes aluminum (Al), chromium (Cr), molybdenum (Mo), platinum (Pt), tantalum (Ta), silver (Ag), titanium (Ti), tungsten (W), copper (Cu), gold (Au), or a combination thereof. The metallic body of the abrasive particles 41 is enabled to conduct the electric current 50 to either the first electrode 13 or the second electrode 15. Meanwhile, the first electrode 13 is electrically coupled to the semiconductor substrate 20 so as to form the circuit loop for transmitting the electric current 50 to the electric current detector 70. Thus, the abrasive particles are useful for precisely detecting whether the endpoint layer is exposed so as to avoid over-polishing.

In some embodiments, an apparatus includes a wafer carrier, a first electrode, a second electrode, a rotatable pedestal, and an electric current detector. The first electrode is disposed at the wafer carrier. The rotatable pedestal is positioned opposite to the wafer carrier in order to perform a polishing operation with the wafer carrier accordingly. The second electrode is disposed at the rotatable pedestal and electrically coupled to the first electrode in order to form a circuit loop. The electric current detector is between the first electrode and the second electrode.

In some embodiments, a method includes dispensing a slurry on a rotatable pedestal in order to perform a grinding operation on a semiconductor substrate including a metal containing layer and a film atop the metal containing layer. The method also includes removing the film atop the metal containing layer thereby exposing the metal containing layer. The method also includes emitting a light on the metal containing layer in order to convert a portion of energy of the light into an electric current. The method also includes detecting the electric current by using an electric current detector.

In some embodiments, a method includes providing a semiconductor substrate including an endpoint layer. The method also includes polishing the film, thereby exposing the endpoint layer. The method also includes emitting an electromagnetic wave toward the endpoint layer. The method also includes converting a portion of the electromagnetic wave into an electric current by the endpoint layer.

Although the subject matter has been described in language specific to structural features or methodological acts, it is to be understood that the subject matter of the appended claims is not necessarily limited to the specific features or acts described above. Rather, the specific features and acts described above are disclosed as example forms of implementing the claims.

Various operations of embodiments are provided herein. The order in which some or all of the operations are described should not be construed as to imply that these operations are necessarily order dependent. Alternative ordering will be appreciated by one skilled in the art having the benefit of this description. Further, it will be understood that not all operations are necessarily present in each embodiment provided herein. It will be appreciated that layers, features, elements, etc. depicted herein are illustrated with particular dimensions relative to one another, such as structural dimensions or orientations, for example, for purposes of simplicity and ease of understanding and that actual dimensions of the same differ substantially from that illustrated herein, in some embodiments.

Further, unless specified otherwise, "first," "second," or the like are not intended to imply a temporal aspect, a spatial aspect, an ordering, etc. Rather, such terms are merely used as identifiers, names, etc. for features, elements, items, etc. For example, a first channel and a second channel generally correspond to channel A and channel B or two different or two identical channels or the same channel.

As used in this application, "or" is intended to mean an inclusive "or" rather than an exclusive "or." In addition, "a" and "an" as used in this application are generally to be construed to mean "one or more" unless specified otherwise or clear from context to be directed to a singular form. Furthermore, to the extent that "includes", "having", "has", "with", or variants thereof are used in either the detailed description or the claims, such terms are intended to be inclusive in a manner similar to "comprising"

What is claimed is:

1. An apparatus, comprising:

a wafer carrier;

a first electrode disposed at the wafer carrier;

a rotatable pedestal positioned opposite to the wafer carrier in order to perform a polishing operation with the wafer carrier accordingly;

a second electrode disposed at the rotatable pedestal and electrically coupled to the first electrode in order to form a circuit loop; and an electric current detector between the first electrode and the second electrode.

2. The apparatus of claim 1, further comprising a light source configured to emit a light toward the wafer carrier, and a wavelength of the light is from about 10 nm to about 390 nm.

3. The apparatus of claim 1, wherein the rotatable pedestal includes a first through hole.

4. The apparatus of claim 3, wherein the first through hole is surrounded by the second electrode.

5. The apparatus of claim 3, wherein the second electrode is in the first through hole and blocks an outlet of the first though hole.

6. The apparatus of claim 1, wherein the rotatable pedestal includes a second through hole for a light emitting toward the wafer carrier.

7. The apparatus of claim 1, wherein the second electrode is transparent to a light emitting toward the wafer carrier.

8. The apparatus of claim 1, wherein the second electrode includes indium tin oxide (ITO), fluorine doped tin oxide (FTO), indium zinc oxide (IZO), poly(3,4-ethylenedioxythiophene) (PEDOT) or aluminium zinc oxide (AZO).

9. The apparatus of claim 1, further comprising a polishing controller coupled to the circuit loop.

10. The apparatus of claim 1, wherein the first electrode or second electrode includes Au, Ag, Pt, $RuO_2$ or a combination thereof.

11. A method, comprising:

dispensing a slurry on a rotatable pedestal in order to perform a grinding operation on a semiconductor substrate including a metal containing layer and a film atop the metal containing layer;

removing the film atop the metal containing layer, thereby exposing the metal containing layer;

emitting a light on the metal containing layer in order to convert a portion of energy of the light into an electric current; and detecting the electric current by using an electric current detector.

12. The method of claim 11, further comprising comparing the electric current detected with a threshold value.

13. The method of claim 12, wherein the threshold value is 0.1 mA.

14. The method of claim 12, wherein the metal containing layer further comprises oxygen.

15. The method of claim 12, further comprising stopping the polishing operation if the detected electric current is greater than the threshold value.

16. A method, comprising:

providing a semiconductor substrate including an endpoint layer with a film thereon;

polishing the film, thereby exposing the endpoint layer;

emitting an electromagnetic wave toward the endpoint layer; and converting a portion of the electromagnetic wave into an electric current by the endpoint layer.

17. The method of claim 16, further comprising retaining the endpoint layer by comparing the electric current to a threshold value.

18. The method of claim 17, wherein the threshold value is about 0.1 mA.

19. The method of claim 16, wherein the converting of the portion of the electromagnetic wave into the electric current includes electrically coupling an electrode to the semiconductor substrate.

20. The method of claim 16, wherein the electromagnetic wave has a wavelength smaller than about 390 nm.

* * * * *